US011673735B2

(12) United States Patent
Buhr et al.

(10) Patent No.: US 11,673,735 B2
(45) Date of Patent: Jun. 13, 2023

(54) TOBACCO PRODUCT PACKAGE

(71) Applicant: IMPERIAL TOBACCO VENTURES LIMITED, Bristol (GB)

(72) Inventors: Carmen Buhr, Hamburg (DE); Vinka Frohlich, Hamburg (DE)

(73) Assignee: Imperial Tobacco Ventures Limited, Bristol (GB)

( * ) Notice: Subject to any disclaimer, the term of this patent is extended or adjusted under 35 U.S.C. 154(b) by 44 days.

(21) Appl. No.: 17/251,044

(22) PCT Filed: Jun. 11, 2019

(86) PCT No.: PCT/EP2019/065098

§ 371 (c)(1),
(2) Date: Dec. 10, 2020

(87) PCT Pub. No.: WO2019/238619

PCT Pub. Date: Dec. 19, 2019

(65) Prior Publication Data

US 2021/0253332 A1 Aug. 19, 2021

(30) Foreign Application Priority Data

Jun. 11, 2018 (EP) ..... 18176900

(51) Int. Cl.
*B65D 85/10* (2006.01)
*B65B 19/02* (2006.01)
*B65D 75/58* (2006.01)

(52) U.S. Cl.
CPC ..... *B65D 85/1027* (2013.01); *B65B 19/025* (2013.01); *B65D 75/5888* (2013.01)

(58) Field of Classification Search
CPC ..... B65D 75/5888; B65D 85/1027
(Continued)

(56) References Cited

U.S. PATENT DOCUMENTS 2,605,897 A * 8/1952 Rundle ..... B65D 75/5844 206/264
2,867,368 A * 1/1959 Kaplan ..... B65D 85/1072 206/806

(Continued)

FOREIGN PATENT DOCUMENTS

DE 102010019867 A1 9/2011
EP 0138649 A2 4/1985

(Continued)

OTHER PUBLICATIONS

International Search Report and Written Opinion for PCT/EP2019/065098 dated Aug. 12, 2019, 16 pages.

(Continued)

*Primary Examiner* — Luan K Bui
(74) *Attorney, Agent, or Firm* — Workman Nydegger

(57) ABSTRACT

The present invention relates to a tobacco product package that comprises at least two, preferably five or more, cylindrically shaped tobacco products aligned in an alignment direction. A wrapping is sheathed around the tobacco products and covers at least part of the outer surfaces of the aligned tobacco products. A tear strip is disposed in the alignment direction along the wrapping and is configured for tearing apart the wrapping when being pulled by a user. According to the present invention, the tear strip has at least one weakening line positioned in the vicinity of an interface of adjacent tobacco products.

14 Claims, 3 Drawing Sheets

(58) Field of Classification Search
USPC ..... 206/256–258, 264, 274; 229/87.14
See application file for complete search history.

(56) References Cited

U.S. PATENT DOCUMENTS

| | | | | |
|---|---|---|---|---|
| 6,799,715 | B1 * | 10/2004 | Bennett | B65D 75/5888 426/123 |
| 7,207,155 | B2 * | 4/2007 | Draghetti | B65D 85/1072 206/274 |
| 9,936,727 | B2 | 4/2018 | Polloni et al. | |
| 2008/0017531 | A1 * | 1/2008 | Tanbo | B65D 85/1072 206/264 |
| 2012/0318690 | A1 * | 12/2012 | Buse | B65D 85/1072 206/256 |
| 2013/0110069 | A1 | 5/2013 | Handel et al. | |
| 2013/0213834 | A1 * | 8/2013 | Koster | B65D 75/02 206/256 |
| 2014/0022486 | A1 | 8/2014 | Kuo et al. | |
| 2015/0115022 | A1 * | 4/2015 | Iwegbu | B65D 75/5888 229/101.1 |

FOREIGN PATENT DOCUMENTS

| | | | |
|---|---|---|---|
| EP | 2002737 | A1 | 12/2008 |
| JP | S6058308 | U | 4/1985 |
| JP | 2002096865 | A | 4/2002 |
| JP | 2010260592 | A | 11/2010 |
| JP | 2012509743 | A | 4/2012 |
| JP | 2013521198 | A | 6/2013 |
| WO | 2011110272 | A1 | 9/2011 |
| WO | 2013175242 | A1 | 11/2013 |
| WO | 2019238619 | A1 | 12/2019 |

OTHER PUBLICATIONS

Extended European Search Report for EP 18176900.1 dated Nov. 30, 2018, 9 pages.
Office Action and Search Report from corresponding TW 108103084 dated Oct. 28, 2019, 7 pages.
Office Action and Search Report from corresponding TW 108103084 dated Apr. 30, 2020, 7 pages.
Office Action from corresponding Japanese Application 2020-568702, dated Jan. 17, 2023.

* cited by examiner

TOBACCO PRODUCT PACKAGE

FIELD OF THE INVENTION

The present invention relates to a tobacco product package and to a method for manufacturing such a tobacco product package.

BACKGROUND

A variety of different tobacco related products is offered on the market, most of which are intended for combustion such as cigarettes, rolling tobacco, cigarillos, or cigars. However some other tobacco related products exist that do not require combustion but are intended for either oral or nasal administration. Examples of such products comprise chewing tobacco, smokeless snuff and snus. Further, a new class of tobacco related products exists, wherein the tobacco is heated without combustion generating vapors through heating, so-called heated tobacco products. In the context of this application the term "heated tobacco products" refers to tobacco products suitable for consumption by heating without combustion and not to tobacco products that have already been heated.

These heated tobacco products are heated to a temperature below the burning temperature of tobacco using a suitable electronic device. The heated tobacco products may have a cylindrical form and comprise a filling of tobacco, reconstituted tobacco, or treated tobacco that is wrapped in a sheathing, wherein the base areas remain uncovered by the sheathing.

If such heated tobacco product is inserted into a fitting receptacle of a respective device, a heating element for heating the filling protrudes into the filling via a first base area or surrounds the tobacco product. If a user draws on a mouthpiece of the electronic device, air can be sucked through the second base area, the heated filling and the first base area and is finally inhaled by the user.

Further, as the tobacco filling may be treated with a volatile substance, e.g. a glycerin-based substance, the packaging of such heated tobacco products is of uttermost importance. Therein, the packaging shall protect the heated tobacco products from environmental influences, such as elevated temperatures or humidity. Above that the packaging shall provide sealing to the heated tobacco products for maintaining their freshness, particularly for preventing drying of the products.

So far, heated tobacco products are usually packaged into small overpacks in the manner of conventional cigarettes, with a plurality of heated tobacco products sitting upright and next to each other within the overpack. However, alternative packages, e.g. comprising multiple heated tobacco products in a space-efficient manner, are of high interest to consumers and manufacturers. Hence, a package and a packaging method for heated tobacco products that allows to package multiple heated tobacco products in a space efficient manner for extended durations is of special commercial interest.

It is thus an object of the present invention to provide a product package for heated tobacco products, particularly multiple heated tobacco products, that provides protection to the heated tobacco products from environmental influences and provides improved sealing for preventing drying of the filling.

SUMMARY OF INVENTION

The disadvantages of the prior art are overcome or at least reduced by the tobacco product package and the method for manufacturing such package according to the appended claims.

According to an aspect of the present invention, a tobacco product package is provided that comprises at least two cylindrically shaped tobacco products that are aligned in an alignment direction. Preferably, the tobacco products are heated tobacco products.

In the tobacco product package, a wrapping covers at least part of the outer surfaces of the aligned tobacco products, preferred of each aligned tobacco product, at least in an initial state. The outer surfaces may comprise lateral cylindrical surfaces and/or base areas of the tobacco products.

A tear strip is disposed in the alignment direction along the wrapping. In other words, the tear strip extends from one terminal end of the aligned and wrapped tobacco products to the opposite terminal end of the aligned and wrapped tobacco products. Therein, the tear strip may extend along the alignment direction in a linear, curved, or zigzag shaped manner. Further preferred, the tear strip helically winds from one terminal end of the aligned wrapped tobacco products towards the opposite terminal end thereof. Therein, the pitch of the helix preferably fits the length of a tobacco product in the alignment direction of the tobacco product. Hence, after each turn of the helix, a single tobacco product can be unwrapped.

The tear strip is configured for tearing apart, tearing up, or rupturing the wrapping when being pulled by a user. In other words, by pulling the tear strip, the wrapping is opened along the alignment direction. Therein, the opening of the wrapping is preferably provided by removing, via the tear strip, a section of the wrapping that is covering the tobacco products.

According to the present invention, the tear strip comprises at least one weakening line that is positioned in the vicinity of an interface of adjacent tobacco products. While the tear strip, in itself, is substantially not rupturable or tearable, it comprises an increased rupturability or tearability at the at least one weakening line. Preferably, the tear strip is configured for tearing off or tearing apart at the at least one weakening line when being pulled by a user.

The present invention thus provides a wrapping package for a plurality of tobacco products that can be easily opened by the tear strip for accessing and withdrawing single tobacco products. Therein, excess opening of the wrapping by pulling the tear strip too far is avoided by providing weakening lines in the vicinity of the interface of adjacent tobacco products. A user can thus easily remove the tobacco products one by one, wherein after withdrawal of a single tobacco product, the remaining tobacco products remain reliably wrapped. Hence, the environmental protection and sealing of the remaining products is reliably continued.

The tobacco product package of the present invention thus allows to offer heated tobacco products that might comprise highly volatile substances, as assemblies comprising multiple such heated tobacco products. Even if the heated tobacco products are not individually wrapped in these assemblies, drying out is reliably prevented by the wrapping that remains even after removal of individual tobacco products.

In a preferred embodiment, the alignment direction of the tobacco products is perpendicular to a longitudinal direction, particularly in a longitudinal direction of the tobacco products. Particularly preferred the longitudinal direction corresponds to the direction of the height of the cylindrically shaped tobacco products. Preferably, the wrapping thus covers at least part of the base areas and of the lateral cylindrical surfaces of the aligned tobacco products. Advantageously, in this embodiment both of the base areas of tobacco products may remain fully covered by the wrapping even after removal of a tobacco product from the wrapping. Hence, drying out of the tobacco products is prevented in a particular efficient manner.

In an alternatively preferred embodiment, the cylindrically shaped tobacco products are aligned in the longitudinal direction, particularly in the longitudinal direction of the tobacco products. Particularly preferred the longitudinal direction corresponds to the direction of the height of the cylindrically shaped tobacco products. Further preferred, the base areas of adjacent tobacco products aligned in the longitudinal direction face each other. In the following it is solely referred to the longitudinal direction as an example of the alignment direction without generally restricting the alignment direction to the longitudinal direction.

According to this alternatively preferred embodiment, the wrapping covers at least part of the lateral cylindrical surfaces of the aligned tobacco products, preferred of each aligned tobacco product, at least in an initial state. Further, the wrapping may extend partially onto the base areas of outermost tobacco products. Advantageously, the rod-shaped assemblies of multiple tobacco products according to this preferred embodiment can be dimensioned like conventional cigarettes. Hence, packaging materials and machines for conventional cigarettes can be advantageously readily utilized or easily adapted for being utilized.

Preferably, the at least one weakening line is sufficiently deep so as to allow the tear strip to rupture or tear up or tear apart upon a pulling force being exerted on the tear strip by a user in a tearing direction of the tear strip. Therein, the depth of the weakening lines and/or the weakened locations (see below) regulate an amount of force necessary to tear up the tear strip. Preferably, a force required to rupture the tear strip at the weakening lines is less or at most equal to the force required for tearing up the wrapping via the pulling of the tear strip.

The aligned tobacco products in the package are preferably (substantially) identical (with each other). In other words, the product package preferably comprises at least two, preferably 3, 4, 5, 6 or more individual identical tobacco products. The tobacco products may be heated tobacco products that comprises a filling of tobacco, reconstituted tobacco, and/or treated tobacco. The filling preferably is of cylindrical shape, particularly preferred of circular cylindrical shape and further preferably surrounded by an envelope shell. The envelope shell may be formed of at least one layer comprising at least one of paper, plastic, aluminum and a combination of these.

According to a particularly preferred embodiment, the position of the at least one weakening line is shifted from the corresponding interface of adjacent tobacco products in a direction that is opposite to a tearing direction of the tear strip. In other words, in a pulling direction of the tear strip, a weakening line is arranged before or upstream the corresponding surface of adjacent tobacco products. Hence, if a user pulls the tear strip for opening the wrapping, the tear strip will rupture at the weakening line thus preventing the tear strip to rupture open the wrapping beyond the next interface. Advantageously, the remaining tobacco products in the package thus remain wrapped and hence protected against drying out.

Further advantageously, due to the shift between a weakening line and a corresponding interface the tear strip protrudes over the terminal end of the remaining tobacco products after removal of a tobacco product from the teared up wrapping. Beneficially, this protruding portion can be easily grabbed by a user for tearing up the next portion of the wrapping.

According to a further preferred embodiment, another portion, e.g. a cantilever portion, of the tear strip extends over a terminal end of the wrapping in a direction opposite to the pulling or tearing direction of the tear strip. Hence, a user can advantageously grab the tear strip easily even for tearing up a first portion of the wrapping. Particularly preferred, the length of the cantilever portion corresponds to, preferably substantially equals, the distance between the interface of adjacent tobacco products and the corresponding weakening line. Hence, the cantilever portion and the remaining protruding portions of the tear strip as described above are of the same length, particularly if the tear strip extends in the longitudinal direction. Thus, user convenience and optical appearance of the tobacco product package are improved.

In a preferred embodiment, the tear strip is attached to the wrapping. Particularly preferred, the tear strip is adhered to the wrapping, e.g. by using a suitable adhesive, by partially welding, hot melting, or hot bonding the tear strip to the wrapping, or the like. Preferably, the tear strip and the wrapping may be of different materials. Particularly preferred, the wrapping may be of a paper material and the tear strip may be of a plastic material. It is advantageous if the tear strip material is in principal more rupture-resistant than the wrapping material. According to this embodiment, the tear strip preferably comprises the at least one weakening line already before being attached to the wrapping. Such attached tear strip may be curved, zigzag-shaped, or the like but most preferred extends linearly along the longitudinal direction.

According to an alternatively preferred embodiment, the tear strip is formed integrally with the wrapping. In other words, the tear strip and the wrapping are made of the same material. Put differently, the tear strip is a part of the wrapping. Particularly preferred, in a cross section of the wrapping, the tear strip is formed as a circumferential section corresponding at most to half of the circumference of the wrapping's cross section. Preferably, the tear strip amounts to less than half, preferably a third, a fourth, a fifth or a sixth the circumference of the wrapping's cross section. Such integral tear strip may be formed linearly, curved, zigzag-shaped, or helically along the wrapping.

Particularly preferred, the tear strip is formed between two substantially parallel weakened tear lines of the wrapping that extend along the longitudinal direction. In other words, at least two tear lines extend in parallel from one terminal end of the wrapping to the opposite terminal end of the wrapping. Therein, the weakened tear lines are configured to rupture open in response to a user pulling the tear strip in a pulling direction thereof. Further preferred, the wrapping and the tear strip are of the same plastic material. According to this particularly preferred embodiment, advantageously no additional tear strip is required.

According to a further preferred embodiment, the tobacco product package also comprises at least one breaking line that extends circumferentially around the wrapping and that is aligned with the interface of adjacent tobacco products. In the product package of the present invention, individual tobacco products are abutted end to end and enclosed by the wrapping.

The breaking lines are positioned in register with the at least one junction between abutted tobacco products. Advantageously, the breaking lines allow for removing excess wrapping after opening a section of the wrapping via the tear strip and removing a tobacco product.

For a tear strip that is attached to the wrapping, the breaking lines preferably extend around the whole perimeter of the wrapping. In order to allow maintaining protruding sections of the tear strip as handles for a user as described above, the tear strip is preferably not attached, e.g. adhered, to the wrapping in vicinity of the breaking lines. Hence, excess wrapping can be removed by rupturing the breaking lines without obstruction by the tear strip. Alternatively, protruding sections of the attached tear strip are omitted and the breaking lines extend over the whole perimeter of the wrapping. Then, weakening lines of the attached tear strip are preferably aligned with the breaking lines for allowing easy removal of excess wrapping.

For a tear strip that is integral to the wrapping, the breaking lines preferably extend not around the whole perimeter of the wrapping. Particularly preferred, the breaking lines extend outside the tear strip over the remaining perimeter of the wrapping. If the tear strip is formed between two substantially parallel weakened tear lines as described above, the breaking lines preferably extend from between the tear lines outside the tear strip. According to this embodiment, weakening lines of the tear strip must not be aligned with breaking lines as excess wrapping can be easily removed along breaking lines and parts of the tear lines.

Preferably, the at least one weakening line is formed by at least one local thinning, at least one cut or a plurality of perforations in the material of the tear strip. The same holds true with respect to the wrapping material for the weakened tear lines and breaking lines.

The at least one weakening line, the at least two weakened tear lines, and/or the at least one breaking line are either interrupted (discontinuous) or continuous. Preferably, the at least one weakening line, the at least two weakened tear lines, and/or the at least one breaking line comprise(s) a plurality of discontinuous weakened locations spaced apart, wherein the weakened locations may take the form of perforations or score lines. Such weakened locations can be formed by various techniques, such as e.g. perforations, score lines, laser cuts and the like. However, at least for the sake of explanation of the usable methods each of the at least one weakening line, the at least two weakened tear lines, and/or the at least one breaking line may be considered to be one formed by a single weakened location.

The at least one weakening line of the tear strip (that might be part of the wrapping), the at least two weakened tear lines of the wrapping, and/or the at least one weakened breaking line of the wrapping can be obtained by multiple identical or different processes or may be obtained by a single process. Whether or not the same process is used may depend on whether the material of the tear strip is identical to that of the wrapping. The choice of the process may further depend on whether the weakening portions are introduced before or after sheathing the wrapping around the aligned tobacco products and on whether the tear strip is attached to or integrally formed with the wrapping material. However, in a particularly preferred embodiment, the at least one weakening line, the at least two weakened tear lines, and the at least one breaking line are obtained by one single process.

In a preferred embodiment, the weakening lines and/or the weakened locations may be formed by inserting perforations at least partially through the tear strip. Alternatively, the weakening lines and/or the weakened locations may be formed by a laser cutting at least partially through the tear strip. Also, perforations may be obtained by mechanical means, e.g. an at least partial cut, electromagnetic radiation, ultrasonic, punching, or industrial solvent or by chemical treatment. The weakening lines and/or the weakened locations may be produced on the tear strip prior to its formation on or in the wrapping. Also, the weakening lines and/or the weakened locations may be formed in the tear strip before it is applied.

Preferably, the at least one weakening location is sufficiently deep so as to allow the tear strip and/or the wrapping to rupture, tear up or tear apart upon sufficient force exerted on the tear strip or the wrapping, respectively, by a user. Therein, the depth of the weakened locations regulates an amount of force necessary to tear up the tear strip and/or the wrapping. Preferably, a force required for tearing up the wrapping via the tear strip is less or at most equal to a force required for tearing apart the excess wrapping at the breaking lines.

With respect to the weakened tear lines and/or the weakened breaking lines, the weakened locations may penetrate only partially through the wrapping so as to maintain the environmental and sealing capabilities of the wrapping placed over the at least two tobacco products. However, with respect to the tear strip, the weakened locations may extend fully there through. The rupture force of the tear strip may thus be less than that of the wrapping.

Preferably, at last one of the wrapping and the tear strip comprises at least one layer from paper, plastic material, or aluminum. Further preferred at least the wrapping is a laminate comprising multiple layers. If the wrapping comprises multiple layers, i.e. is a composite or laminate, the multiple layers may be laminated together or may employ an adhesive.

From a functional point of view, the wrapping is preferably inflammable and at least heat-retardant and/or does not emit hazardous substances when being heated and/or does not damage an electronic device if it is erroneously inserted therein. Further preferred, the wrapping material provided is sufficiently water and vapour impermeable, provides a sufficient barrier with respect to other materials as well, i.e. sufficient sealability, and is cost effective. The wrapping may be opaque, translucent, or transparent at one or more areas of thereof. Additionally, one or more trade marks, logos, or the like may be printed to the wrapping.

Further preferred, the material of the wrapping and the tear strip is generally not readily rupturable or tearable, i.e. rupture-resistant or tear-resistant. In other words, the rupturability or tearability of the wrapping and the tear strip, i.e. the property that a user can tear apart at least pieces of the wrapping and/or the tear strip is provided only by the at least one weakening line, the at least two weakened tear lines, and the at least one breaking line.

Particularly preferred the wrapping consists of at least one of a paper, aluminum foil, metal foils, plastic foil, aluminum-coated foil, aluminum-coated paper, plastic-coated paper, laminates, fleece, each of the aforementioned being either perforated or non-perforated.

Further preferred, a plastic material is used for the wrapping, such as e.g. a sheet of plastic or film wrap. Exemplarily, one or more of the following plastic materials can be employed for the wrapping: polyester, metalized polyester, different polyprolylenes (PPs), metalized polypropylene, polyethylenes (PE's, including for example LDPE, MDPE, and HDPE), or polyethylene co-polymers (including LLDPE, EVA).

According to a particularly preferred embodiment, at least one layer of wrapping material is sheathed at least around the lateral cylindrical surfaces of the at least two aligned tobacco products. In other words, the wrapping is not disposed around the tobacco products by shrinking, wherein shrinking is also preferred, but is wrapped around the aligned tobacco products and is joined with itself within at least one seam area or within an overlap area. In a seam area, the wrapping material is preferably welded to itself, wherein in the overlap area the wrapping material may also be adhered to itself, e.g. by a suitable adhesive. Further, an overlap area may be limited at both lateral sides by a seam area. In other words, an overlap area may be formed by connecting a wrapping sheet to itself via two welding seams.

According to this preferred embodiment, one of the at least one weakened tear line preferably corresponds to the seam area. Further preferred, the at least two weakened tear lines are positioned at the fringes of the overlap area. Advantageously, weakened locations may be applied to the wrapping material in the same process that is used for welding, e.g. by utilizing a laser with different irradiation strength for forming welding seams and weakened locations. Further preferred, the tear strip corresponds to the overlap area. Advantageously, an integral tear strip is thus formed with double the material strength of the other wrapping.

Another aspect of the present invention relates to a method for manufacturing a tobacco product package, particularly a tobacco product package as described above. The method of the invention comprises at least the following steps: First, at least two cylindrically shaped tobacco products are aligned in a longitudinal direction such that the base areas of adjacent tobacco products face each other. Then, the aligned tobacco products are sheathed by a wrapping layer. The sheathing can be done by applying a preformed tube of sheathing material around the aligned tobacco products and by tightly shrinking the tube onto the aligned tobacco products. Such shrinking may be done through the application of heat or hot air to a surface of the wrapping. Alternatively, a sheet of wrapping is wrapped around the tobacco products and attached to itself in a seam area and/or an overlap area. The sheet of wrapping may be attached to itself e.g. by welding, or by gluing it to itself with an adhesive.

The method of the present invention further comprises the steps of inserting, into the wrapping layer, at least two substantially parallel weakened tear lines that extend along a longitudinal direction in order to form a tear strip integrally from the wrapping material. In the method of the invention, further at least one weakened breaking line that extends at least partially around the perimeter of the wrapping, i.e. in a direction substantially perpendicular to the longitudinal direction, is inserted into the wrapping layer. Further, the weakened breaking line may be aligned with the interface between adjacent tobacco products. In the method of the invention further at least one weakening line is inserted into the tear strip. Therein, the weakening line preferably extends substantially perpendicular to the longitudinal direction and is preferably positioned in the vicinity of an interface of adjacent tobacco products.

The inserting of the at least two weakened tear lines, of the at least one breaking line, and of the at least one weakening line is preferably performed by a laser, by stamping or by cutting.

However, for inserting the weakening line, the weakened tear lines, and/or the breaking line in principal any of the processes as described above with respect to the tobacco product package can be used in the method of the invention.

Further, the inserting of the at least two weakened tear lines, the at least one breaking line, and the at least one weakening line can be performed after or before sheathing the aligned tobacco products. However, if the inserting is performed before, i.e. if a pre-perforated wrapping is utilized for sheathing the tobacco products, the positions of the interfaces of adjacent tobacco products are the expected positions of such interfaces. Preferably in such case, the wrapping layer may be pre-perforated with (lateral) lines of perforations aligned across a width of the wrapping layer, wherein each row is separated from the adjacent row by a distance corresponding to the length of a single tobacco product. Further, the circumferential direction of the wrapping is the expected circumferential or width direction.

BRIEF DESCRIPTION OF DRAWINGS

Further aspects of the invention will become apparent to those of skill in the art by describing in detail exemplary embodiments with reference to the attached drawings in which.

DETAILED DESCRIPTION OF EXAMPLE EMBODIMENTS

Figure 1:
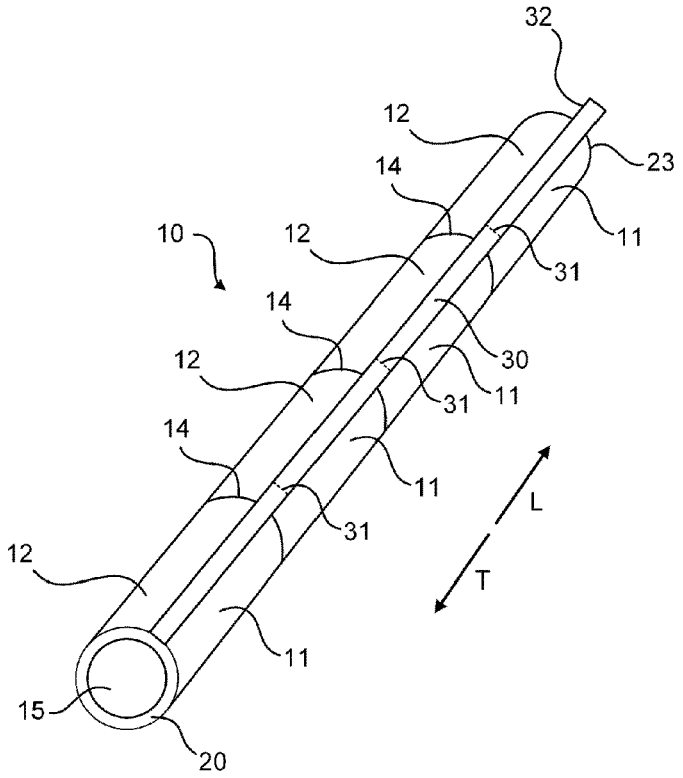
FIG. 1 illustrates a schematic perspective view of a tobacco product package according to a first embodiment.

FIG. 1 is a schematic perspective view of a tobacco product package 10 according to a first embodiment of the present invention. The tobacco product package 10 comprises four tobacco products 11 that are aligned in a longitudinal direction L such that base areas 15 of adjacent tobacco products 11 face each other at the interfaces 14 between adjacent tobacco products 11. The plurality of aligned tobacco products 11 are wrapped in a wrapping 20 that covers the lateral cylindrical surfaces 12 of the tobacco products 11. Although FIG. 1 illustrates four aligned tobacco products 11 other numbers are also possible.

Each of the tobacco products 11 is a heated tobacco product 11 comprising a filling of reconstituted tobacco that is treated with a glycerin-based substance and comprises a paper wrap around said filling. Each tobacco product 11 has a length of 15 mm in the longitudinal direction L, wherein the length is adapted to a corresponding cavity of a electronic device (not shown). However, other lengths, e.g. in the range of 6 mm to 100 mm, preferred 15 mm to 40 mm, are also possible. The diameter of each of the tobacco products 11 shown in FIG. 1 is about 7.8 mm. However, other diameters, such as diameters of about 4.5 mm to about 10 mm are also possible.

The tobacco product package 10 of FIG. 1 further comprises a tear strip 30 that is attached to the wrapping 20. Therein, the tear strip 30 is glued along its whole length to an outer surface of the wrapping 20. The tear strip 30 comprises a plurality of weakening lines 31, wherein each weakening line 31 is positioned in the vicinity of an interface 14 between adjacent tobacco products 11. Particularly, each weakening line 31 is spaced apart from its corresponding interface 14 in the longitudinal direction L. At a terminal end 23 of the wrapping, the tear strip 30 protrudes over the wrapping 20 and thus forms a cantilever portion 32. Therein, the length of the cantilever portion 32 in the longitudinal direction L equals the distance between the weakening lines 31 and the corresponding interfaces 14.

Each weakening line 31 is formed by a plurality of perforations extending in a width direction of the tear strip 30, i.e. substantially perpendicular to the longitudinal direction L. A user that grabs the tear strip 30 at the cantilever portion 32 and pulls it into a tearing direction T opposite to the longitudinal direction L initially tears apart the wrapping 20 in a first section thereof, which corresponds to the outermost tobacco product 11. Therefore, the adhesive force of the glue between wrapping 20 and tear strip 30 exceeds the force required for tearing apart the wrapping 20. When the tear strip 30 is teared through the wrapping 20 and reaches the weakening line 31, the tear strip 30 ruptures at the weakening line 31 and the tearing of the wrapping 20 is discontinued. A force required for tearing apart the wrapping 20 is higher than the force required for tearing apart the tear strip 30.

Figure 2:
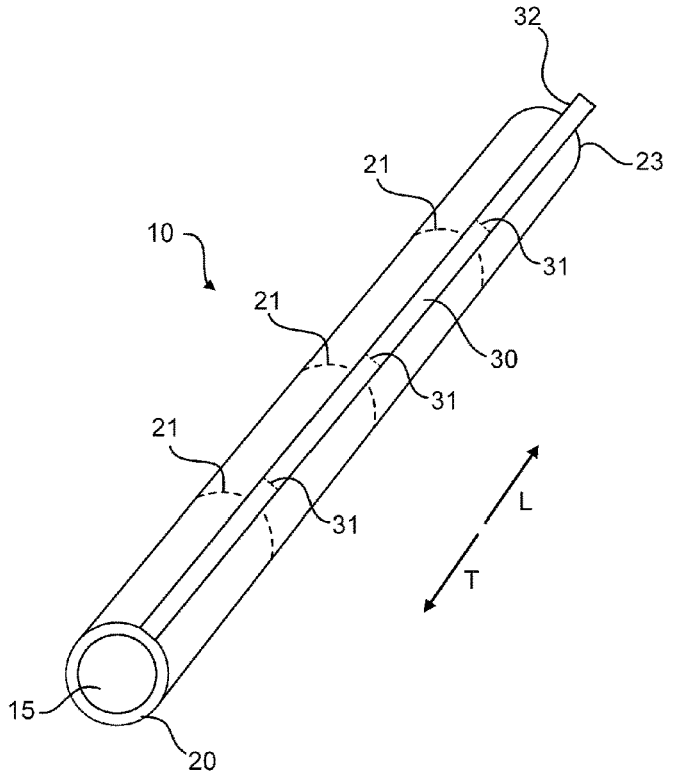
FIG. 2 illustrates a schematic perspective view of a tobacco product package according to a second embodiment.

FIG. 2 illustrates a schematic perspective view of a tobacco product package 10 of a second embodiment with same features being denoted with like reference signs as in FIG. 1.

The tobacco product package 10 of the second embodiment differs from that of the first embodiment in that the wrapping 20 comprises a plurality of breaking lines 21 that extend around the perimeter of the wrapping 20 at the positions of the interfaces 14 between adjacent tobacco products 11 as shown in FIG. 1. Further, in the second embodiment the tear strip 30 is only partially adhered to the wrapping 20, wherein it is not adhered to the wrapping 20 in the vicinity of the interfaces 14 between tobacco products 11, i.e. the breaking lines 21.

Hence, if a user grabs the tear strip 30 at the cantilever portion 32 and pulls it in the tearing direction T, again a first section of the wrapping 20 corresponding to an outermost tobacco product is teared apart until the tear strip 30 ruptures at weakening line 31. Then, the user can remove the excess wrapping 20 by tearing it apart at the breaking line 21. Therewith, a new terminal end of the tobacco product package 10 is formed. The tear strip 30 extends to the position of the former weakening line 31 and thus protrudes over this new terminal end.

Figure 3:
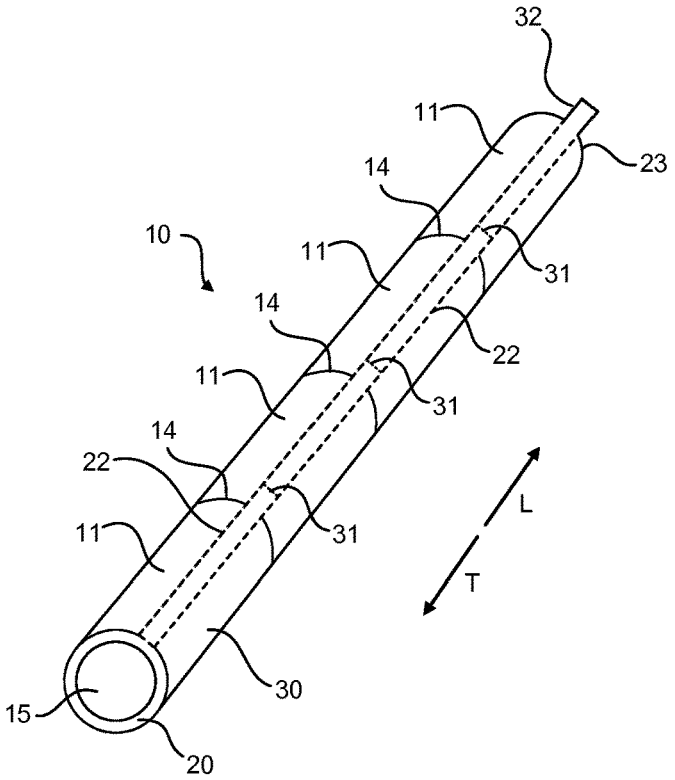
FIG. 3 illustrates a schematic perspective view of a tobacco product package according to a third embodiment.

FIG. 3 illustrates a schematic perspective view of a tobacco product package 10 of a third embodiment with same features being denoted with like reference signs as in FIGS. 1, 2.

In the third embodiment, the tear strip 30 is formed integral with the wrapping 20. Particularly, the tear strip 30 is formed by two weakened tear lines 22 that extend in parallel along the longitudinal direction L of the package 10. Particularly preferred, the weakened tear lines 22 as well as the weakening lines 31 are formed by a plurality of weakening locations, e.g. perforations. Therein, a depth and/or a size of the weakening locations of the weakening lines 31 exceed the depth of the weakening locations of the weakened tear lines 22. Thus, the tear strip 30 ruptures along weakening lines 31 at a lower pulling force than that required for tearing apart the tear strip 30 from the remaining wrapping 20 along the tearing lines 20.

Figure 4:
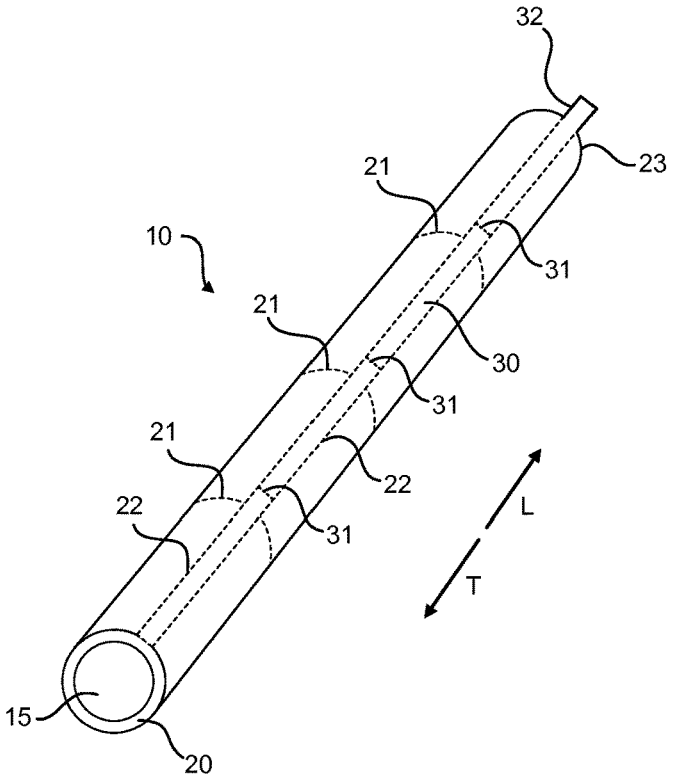
FIG. 4 illustrates a schematic perspective view of a tobacco product package according to a fourth embodiment.

FIG. 4 illustrates a schematic perspective view of a tobacco product package 10 of a fourth embodiment with same features being denoted with like reference signs as in FIGS. 1 to 3.

The tobacco product package 10 of the fourth embodiment differs from that of the third embodiment in that the wrapping 20 comprises a plurality of breaking lines 21 that extend partially around the perimeter of the wrapping 20 at the positions of the interfaces 14 between adjacent tobacco products 11 as shown in FIG. 3. Therein, the breaking lines 21 terminate at the weakened tearing lines 22, respectively, and do not extend across the tear strip 30. A weakening location across the full circumference of the wrapping 20 is however formed by the combination of a breaking line 21 and the corresponding weakening line 31.

Figure 5:
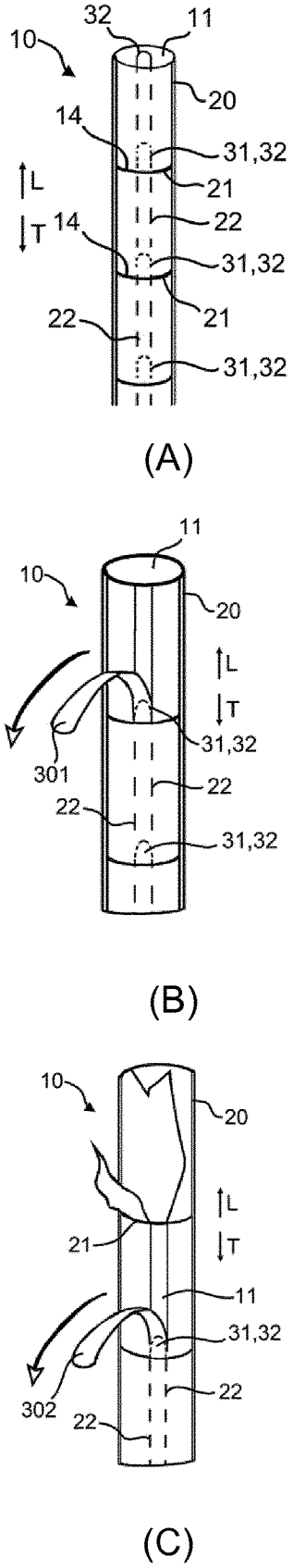
FIG. 5 illustrates the process of opening a tobacco product package according to the fourth embodiment.

The process of opening a tobacco product package according to the fourth embodiment is illustrated in more detail in the FIGS. 5*a* to 5*c*. In FIG. 5, solid lines indicate the interfaces 14 between adjacent tobacco products 11 and breaking lines 21 aligned with these interfaces 14.

In FIG. 5*a* the tobacco product package 10 as illustrated in FIG. 4 is shown in upright configuration. As only difference to the package 10 shown in FIG. 4, the weakening lines 31 are not straight lines but are formed in a curved manner between the tear lines 22. As further shown in FIG. 5*a*, a cantilever portion 32 protrudes over a terminal end of the wrapping 10 and provides a handle for a user to easily grab the tear strip 30.

As shown in FIG. 5*b*, if a user pulls the tear strip 30 in the tearing direction T, the tear strip 30 ruptures apart from the remaining wrapping 20 along the weakened tear lines 22. Once, the drawn tear strip 30 reaches the weakening line 31, the tear strip 30 ruptures apart from the remaining package 10 along the weakening line 31. Hence, the user can remove the torn-off portion 301 of the tear strip 30 such that a tip of the tear strip 30 protruding over the next breaking line 21 forms a new cantilever portion 32. The user can then remove the excess wrapping 20 along the breaking line 21 (not shown) or let it stay on the package 10.

As illustrated in FIG. 5*c*, by grabbing the cantilever portion 32 of the next section 302 of tear strip 30 and by pulling it in the tearing direction, the user can tear apart the next section of the wrapping 20. Therein, the tear strip 30 ruptures apart from the remaining wrapping 20 along the weakened tear lines 22 until it reaches the next weakening line 31. There, section 302 of tear strip 30 ruptures apart and is removed from the remaining package 10. Again, the user can then remove the excess wrapping 20 along the breaking line 21 (not shown) or let it stay on the package 10. With the tobacco product package 10 of the present invention, individual tobacco products are conveniently removed from a wrapping by utilizing a tear strip, wherein excess rupture of the wrapping is avoided and thus sealing is improved.

The invention claimed is:

1. A tobacco product package, comprising:

at least two cylindrically shaped tobacco products aligned having outer surfaces in an alignment direction;

a wrapping covering at least part of the outer surfaces of the aligned tobacco products; and a tear strip disposed in the alignment direction along the wrapping and being configured for tearing apart the wrapping when being pulled by a user, characterized in that the tear strip has at least one weakening line positioned in the vicinity of an interface of adjacent tobacco products, and wherein the position of the at least one weakening line is shifted from the corresponding interface of adjacent tobacco products in a direction opposite to a tearing direction of the tear strip.

2. The tobacco product package of claim 1, wherein:

the alignment direction is perpendicular to a longitudinal direction; and the wrapping covers at least part of the base areas and the lateral cylindrical surfaces of the aligned tobacco products.

3. The tobacco product package of claim 1, wherein:

the at least two cylindrically shaped tobacco products are aligned in a longitudinal direction;

the wrapping covers at least part of the lateral cylindrical surfaces of the aligned tobacco products; and the tear strip is disposed in the longitudinal direction.

4. The tobacco product package of claim 1, wherein a cantilever portion of the tear strip extends over a terminal end of the wrapping in a direction opposite to a tearing direction of the tear strip.

5. The tobacco product package of claim 4, wherein the length of the cantilever portion corresponds to the distance between the interface of adjacent tobacco products and the corresponding weakening line.

6. The tobacco product package of claim 1, wherein the tear strip is configured for tearing off at the at least one weakening line when being pulled by a user.

7. The tobacco product package of claim 1, wherein the tear strip is attached to the wrapping.

8. The tobacco product package of claim 1, wherein the tear strip is formed integrally with the wrapping.

9. The tobacco product package of claim 1, wherein the tear strip is formed between two substantially parallel weakened tear lines of the wrapping that extend along the alignment direction.

10. The tobacco product package of claim 1, further comprising at least one breaking line extending circumferentially around the wrapping and being aligned with the interface of adjacent tobacco products.

11. The tobacco product package of claim 9, wherein the at least two weakened tear lines, the at least one weakening line, and the at least one breaking line are obtained by one process.

12. The tobacco product package of claim 1, wherein the at least one weakening line is formed by at least one local thinning, at least one cut or a plurality of perforations in the material of the tear strip.

13. The tobacco product package of claim 1, wherein the wrapping and/or the tear strip comprises at least one layer from paper, plastic material, or aluminum.

14. The tobacco product package of claim 1, wherein at least one layer is sheathed around the outer surfaces of the at least two tobacco products, wherein the at least one sheathed layer is joined with itself in at least one seam area or in an overlap area, and wherein at least one weakened tear line corresponds to at least one of the seam area and/or is positioned at the fringe of the overlap area, and/or wherein the tear strip corresponds to the overlap area.

* * * * *